US008479761B2

(12) United States Patent
Yang

(10) Patent No.: US 8,479,761 B2
(45) Date of Patent: Jul. 9, 2013

(54) DEVICE USED IN DIGITAL SHOWER SYSTEM

(75) Inventor: Chaota Yang, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 456 days.

(21) Appl. No.: 12/884,117

(22) Filed: Sep. 16, 2010

(65) Prior Publication Data

US 2011/0290356 A1 Dec. 1, 2011

(30) Foreign Application Priority Data

May 26, 2010 (CN) ..... 2010 1 0184109

(51) Int. Cl.
*F16L 5/00* (2006.01)

(52) U.S. Cl.
USPC ..... 137/360; 137/359; 4/676; 4/695

(58) Field of Classification Search
USPC ..... 137/359, 360; 4/596, 597, 676, 695
See application file for complete search history.

(56) References Cited

U.S. PATENT DOCUMENTS

| | | | | | |
|---|---|---|---|---|---|
| 1,693,758 | A * | 12/1928 | Hennessey | 137/636.2 |
| 3,609,774 | A * | 10/1971 | Allgood | 4/695 |
| 3,733,622 | A * | 5/1973 | Searles | 4/695 |
| 4,654,900 | A * | 4/1987 | McGhee | 4/670 |
| 4,941,608 | A * | 7/1990 | Shimizu et al. | 236/12.12 |
| 4,945,943 | A * | 8/1990 | Cogger | 137/360 |
| 5,046,521 | A * | 9/1991 | Jensen | 137/360 |
| 5,845,673 | A * | 12/1998 | Paul | 137/360 |
| 6,438,770 | B1 * | 8/2002 | Hed et al. | 4/668 |
| 6,478,285 | B1 * | 11/2002 | Bergmann | 251/129.03 |
| 6,705,534 | B1 * | 3/2004 | Mueller | 236/12.12 |
| 6,895,610 | B2 * | 5/2005 | Olson | 4/671 |
| 2006/0196549 | A1 * | 9/2006 | Roje et al. | 137/359 |

* cited by examiner

*Primary Examiner* — John Fox
*Assistant Examiner* — Kevin Murphy

(57) ABSTRACT

A device used in a digital shower system contains a valve box including a housing fixed on a frame; a temperature control valve installed in the housing to mix cold and hot waters together; two inlet pipes to supply the cold and the hot waters toward the temperature control valve respectively; a motor to drive the temperature control valve; two outlet pipes to output mixed cold and hot water; two solenoid valve to turn on and off the outlet pipe; a controlling panel to control the valve box including a first abutting portion to contact with an external face of a front fence of the device and to close a groove of the front fence, a retaining means including two second bolts and two orifices, the second bolt being inserted through the controlling panel to screw with the orifice so that the first abutting portion abuts against the external face.

20 Claims, 19 Drawing Sheets

DEVICE USED IN DIGITAL SHOWER SYSTEM

BACKGROUND OF THE INVENTION

1. Field of the Invention

The present invention relates to a device used in a digital shower system, an installing method and structure thereof.

2. Description of the Prior Art

A conventional digital shower system includes a valve box and a controlling panel, and the valve box and the controlling panel are installed in two spaces separately, however because a user has to operate the controlling panel during having a shower, the controlling panel is installed in a showering room, and the valve box is installed in another space.

Nevertheless, such a conventional digital shower system has the following defects:

1. The valve box and the controlling panel are installed in two different spaces, thus increasing installation and construction costs.

2. When the digital shower system is broken, a repair person has to check and repair the valve box and the controlling panel in two different spaces, having inconvenient checking and repairing process.

3. When a break happens among a circuit, a controlling line, and a water route, for example, when a water leak happens in the water route, the repair person has to check in two different spaces time consumingly.

4. The valve box and the controlling panel are installed in two spaces separately to occupy installing spaces.

The present invention has arisen to mitigate and/or obviate the afore-described disadvantages.

SUMMARY OF THE INVENTION

The primary object of the present invention is to provide a device used in a digital shower system which is capable of overcoming the shortcomings of the conventional shower faucet thereof.

Further object of the present invention is to provide a device used in a digital shower system that when the valve box is cleaned, checked and maintained, the adjusting knob of the first embodiment or the body of the second embodiment is removed so that the second bolts of the retaining means are exposed outside to be rotated releasably to remove the controlling panel of the first embodiment or the body of the second embodiment, such that the cleaning, checking, and maintaining process is executed through the groove of the front fence easily. Also, the cover of the valve box is removed from the groove so that the inner circuit, the water route, and the related components of the valve box are cleaned and check easily and quickly.

Another object of the present invention is to provide a device used in a digital shower system that the installing structures are used to make the controlling panel and the valve box locate at the same wall to lower installing space and a distance between the circuit and the water route, thus decreasing installation cost and facilitating the cleaning and checking process.

Also another object of the present invention is to provide a device used in a digital shower system that a predetermined screwing travel between the second bolts and the orifices is adjusted automatically, for example, when the same device is installed onto the front fences with different thickness respectively, the screwing travel is adjusted automatically, wherein as the thickness of the front fence of the wall is within a common range, the retaining means is used to adjust the screwing travel based on different thicknesses of the front fences so that the first and the second abutting portions of the controlling panel are engaged with the external face of the front fence after the retaining means is embodied without being influenced by the thicknesses of the front fence. Therefore, the device of the present invention is applicable to various front fences with different thicknesses.

To obtain the above objectives, a device used in a digital shower system provided by the present invention comprises a valve box including a housing fixed on a frame;

a temperature control valve installed in the housing to mix cold and hot waters together;

two inlet pipes to supply the cold and the hot waters toward the temperature control valve respectively;

a motor to drive the temperature control valve;

at least one outlet pipe to output mixed cold and hot water in the temperature control valve;

at least one solenoid valve to turn on and off the outlet pipe;

a controlling panel to control and operate the valve box, and including a first abutting portion mounted around a peripheral side of a back surface thereof to contact with an external face of a front fence formed on a front side of the device and to close a groove of the front fence, and a back side of the controlling panel corresponding to the valve box through the groove;

a retaining means including at least one second bolt, and at least one orifice in response to the second bolt, the second bolt being inserted through a predetermined portion of the controlling panel to screw with the orifice by using a determined screwing travel so that the first abutting portion of the controlling panel is biased against the external face of the front fence.

An installing method of a device used in a digital shower system includes the steps of:

a. preparing the device used in the digital shower system, wherein the device comprise a valve box and a controlling panel to control the valve box; the valve box includes a housing; a temperature control valve installed in the housing to mix cold and hot waters together; two inlet pipes to supply the cold and the hot waters toward the temperature control valve respectively; a motor to drive the temperature control valve; at least one outlet pipe to output mixed cold and hot water in the temperature control valve; at least one solenoid valve to turn on and off the outlet pipe; the controlling panel includes a first abutting portion mounted around a peripheral side of a back surface thereof;

b. preparing and connecting a frame; wherein the frame is connected at a suitable position of a showering room;

c. connecting the valve box of the device on the frame;

d. coupling a front fence onto the frame; wherein the front fence includes a groove in response to the valve box;

e. abutting the first abutting portion of the controlling panel against an external face of the front fence so that the groove of the front fence is covered completely;

f. engaging the controlling panel with the front fence by using at least one second bolt and at least one bore of a retaining means, wherein the second bolt is inserted through a predetermined portion of the controlling panel to screw with an orifice of the cover so that the first abutting portion of the controlling panel engages with the external face of the front fence to install the device.

An installing structure of a device used in a digital shower system comprising a wall, and the wall including a frame and a front fence fixed on the frame, the front fence includes a groove formed in a predetermined size and shape;

a valve box including:

a housing fixed on the frame and corresponding to the groove of the front fence;

a temperature control valve installed in the housing to mix cold and hot waters together;

two inlet pipes to supply the cold and the hot waters toward the temperature control valve respectively;

a motor to drive the temperature control valve;

at least one outlet pipe to output mixed cold and hot water in the temperature control valve;

at least one solenoid valve to turn on and off the outlet pipe;

a controlling panel including a first abutting portion mounted around a peripheral side of a back surface thereof to contact with an external face of the front fence and to close the groove of the front fence, and a back side of the controlling panel corresponding to the valve box through the groove;

a retaining means including at least one second bolt, and at least one orifice in response to the second bolt, the second bolt being inserted through a predetermined portion of the controlling panel to screw with the orifice by using a determined screwing travel so that the first abutting portion of the controlling panel is biased against the external face of the front fence.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
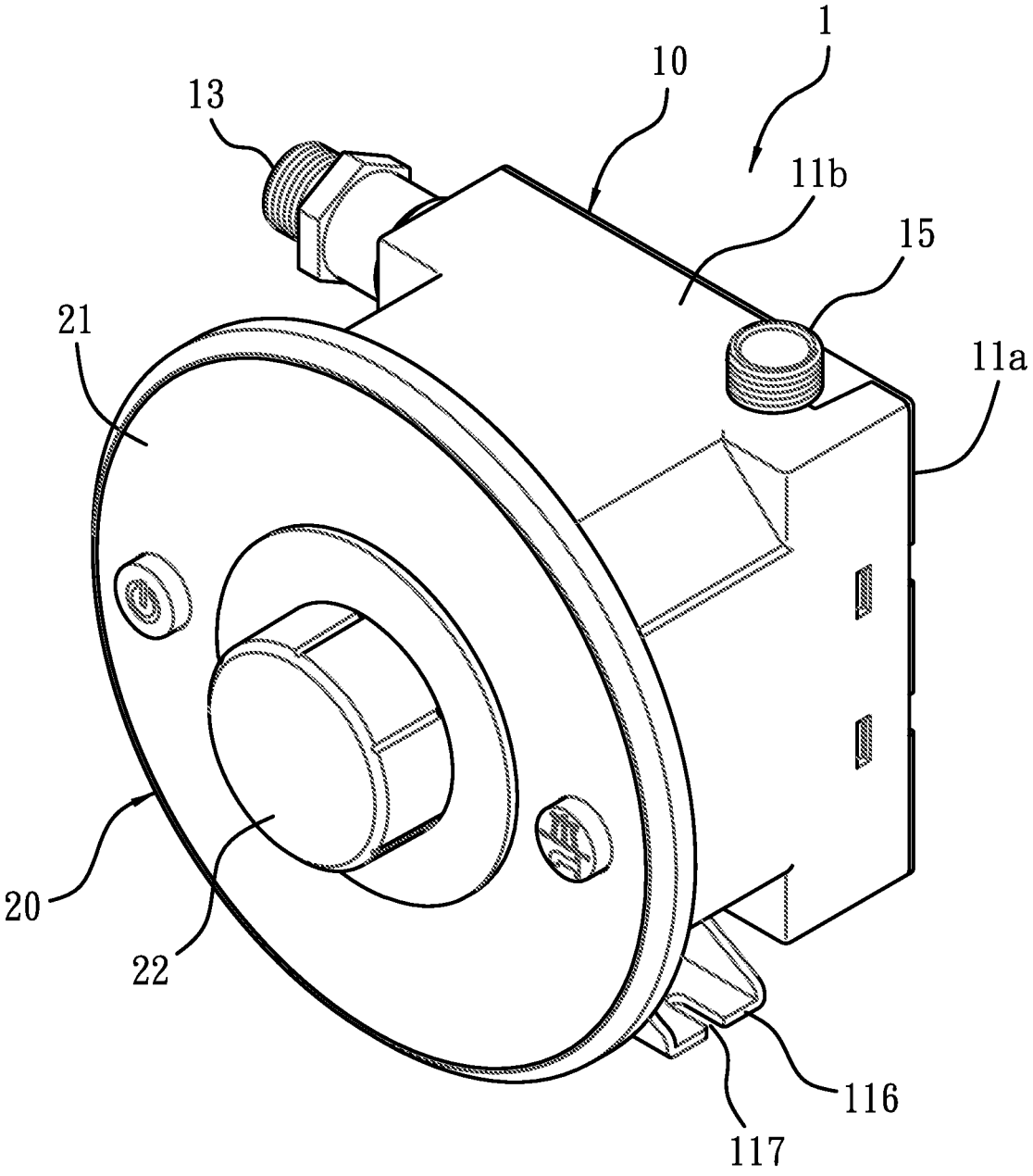
FIG. 1 is a perspective view showing the assembly of a device used in a digital shower system according to a first embodiment of the present invention.
Figure 2:
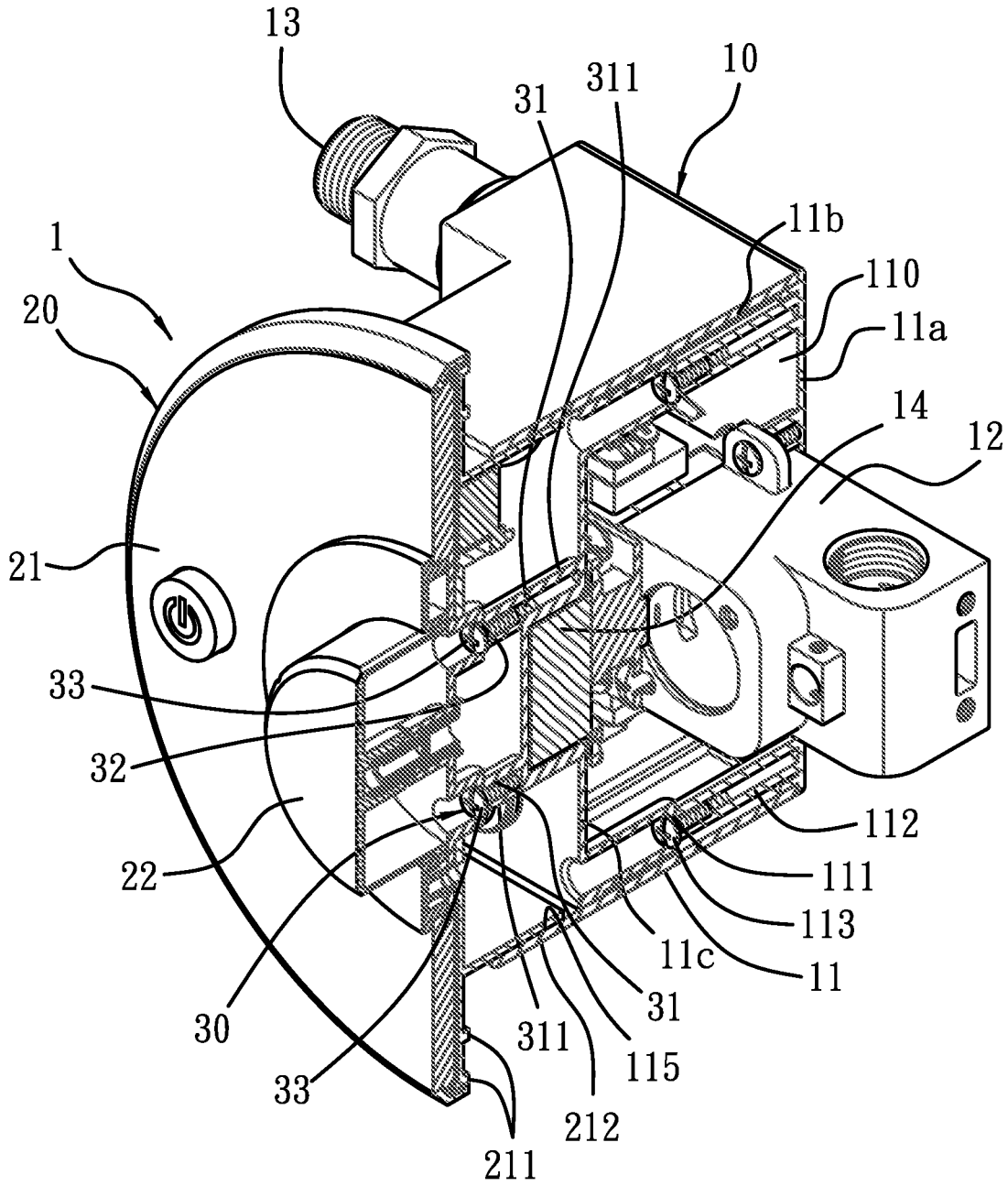
FIG. 2 is a perspective view showing the cross section of the assembly of the device used in the digital shower system according to the first embodiment of the present invention.
Figure 3:
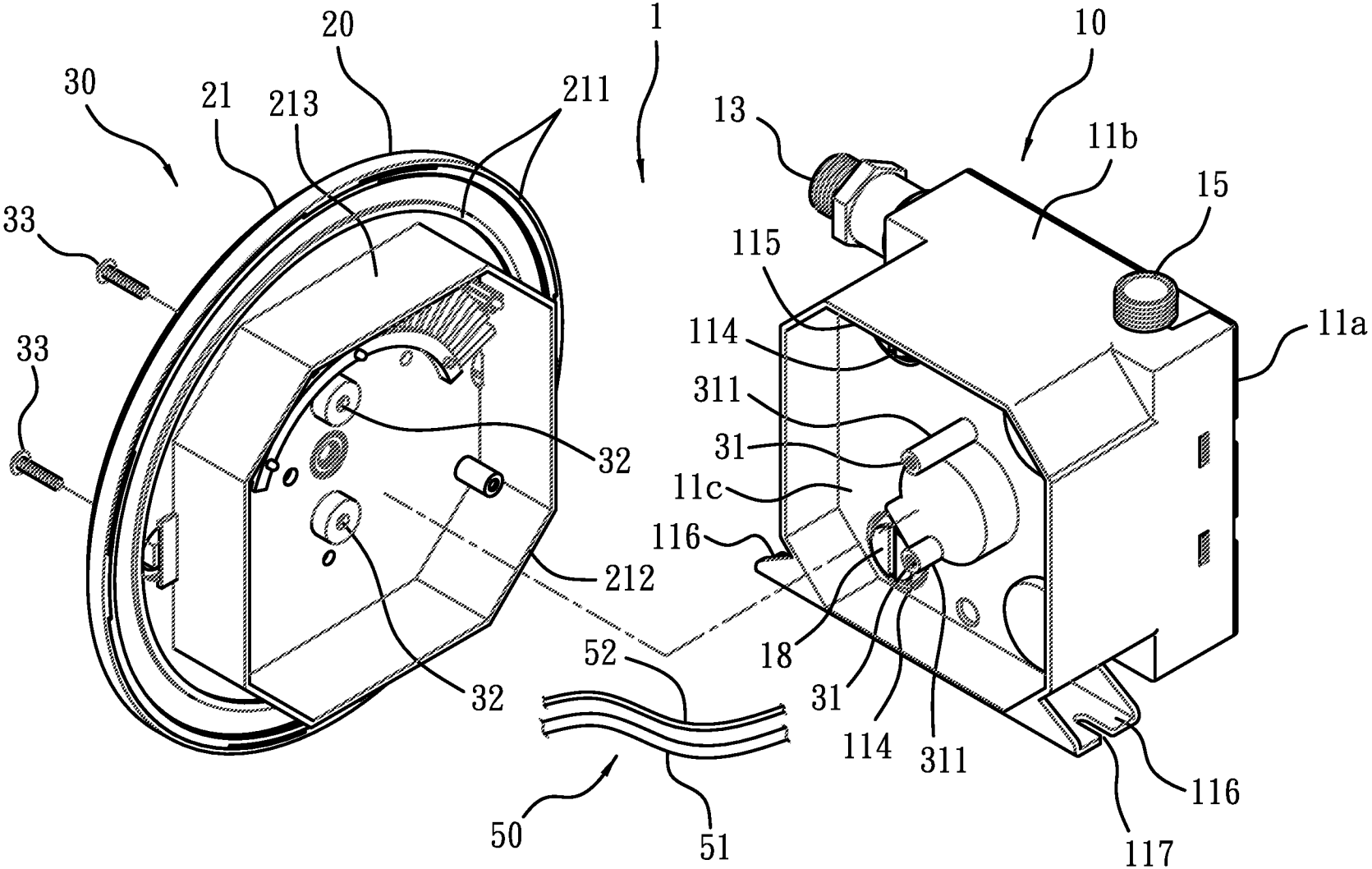
FIG. 3 is a perspective view showing the exploded components of the device used in the digital shower system according to the first embodiment of the present invention.

Referring to FIGS. 1-3, a device 1 used in a digital shower system according to a first embodiment of the present invention comprises a valve box 10, a controlling panel 20, a retaining means 30, and a closing means 40.

Figure 6:
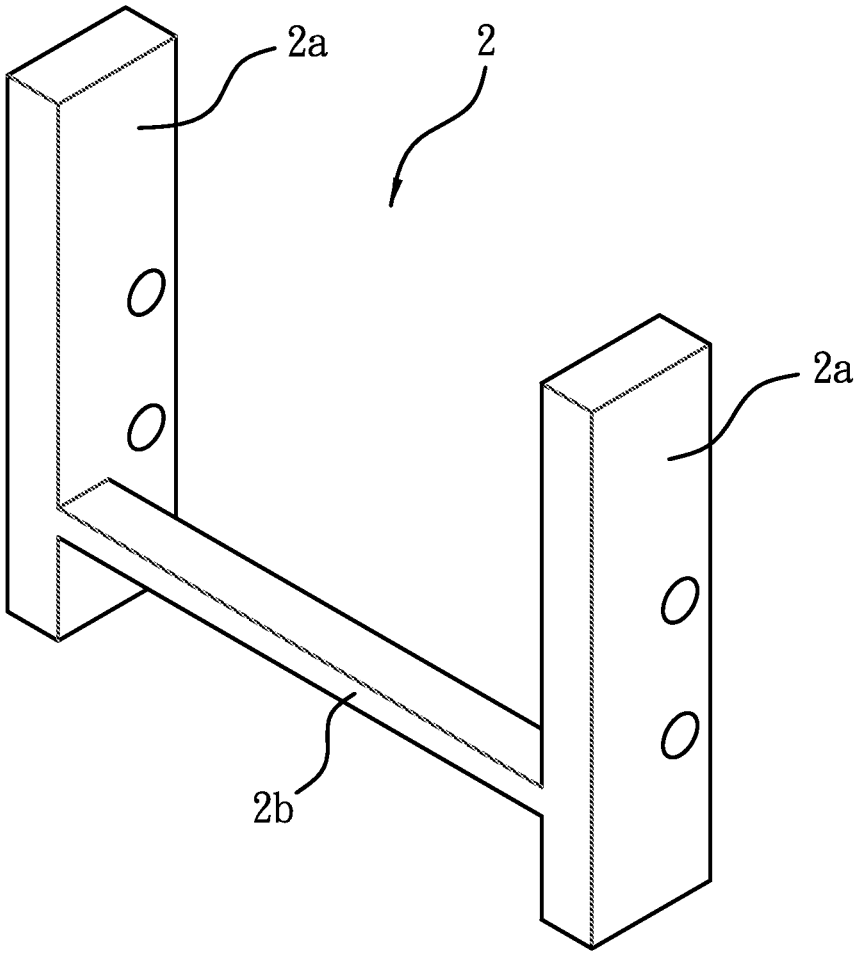
FIG. 6 is a perspective view showing the assembly of a frame of the device used in the digital shower system according to the first embodiment of the present invention.
Figure 7:
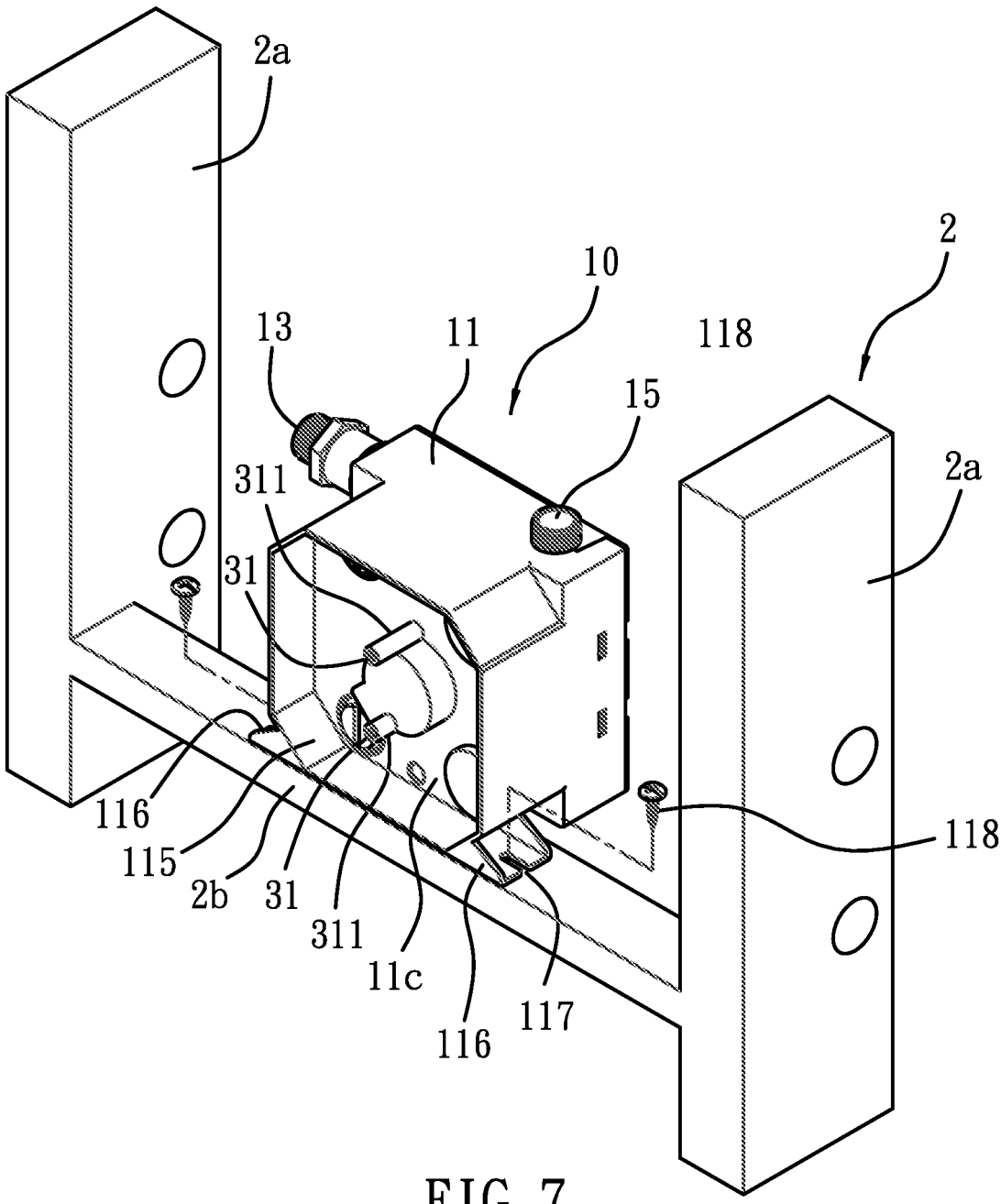
FIG. 7 is a perspective view showing the operation of a valve box being connected onto a frame according to the first embodiment of the present invention.

The valve box 10 includes:

a housing 11 fixed on a frame 2 as shown in FIGS. 6 and 7, and including a seat 11*a*, a side fringe 11*b* connected with a peripheral side of the seat 11*a*, and a removable cover 11*c* locked on the seat 11*a* thereof, among the seat 11*a*, the side fringe 11*b*, and the cover 11*c* being defined a chamber 110, wherein between the seat 11*a* and the side fringe 11*b* are defined two holes 111 to correspond to two screw elements 112 defined between the cover 11*c* and the seat 11*a* so that the cover 11*c* is inserted through the holes 111 by using two first bolts 113 to screw with the screw elements 112 and installed on the seat 11*a* to generate a close state, and the cover 11*c* includes two apertures 114 formed therein.

The side fringe 11*b* of the housing 11 includes a non-circular first cliff 115 arranged thereon; in this embodiment, the first cliff 115 is formed in an octagon shape, and a profile of the side fringe 11*b* in response to an outer surface of the first cliff 115 matches with an inner surface of a groove 3*b*.

The side fringe 11*b* of the housing 11 includes two legs 116 extending from a suitable portion of an outer surface thereof, and each leg 116 includes two openings 117 disposed thereon to receive a locking element 118 used to screw the housing 11 and the frame 2 together.

Figure 4:
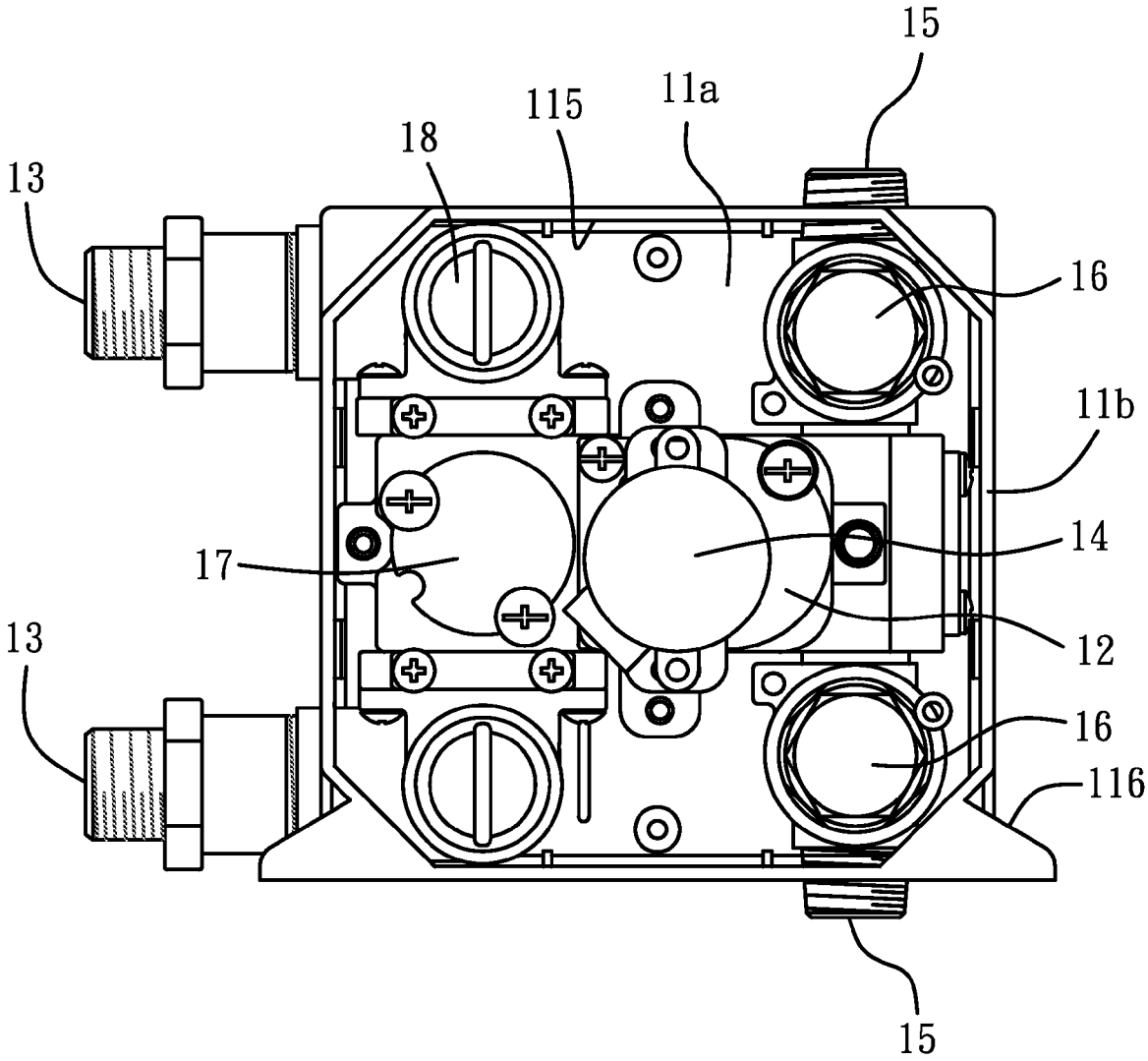
FIG. 4 is a pane view showing the assembly of a valve box of the device used in the digital shower system according to the first embodiment of the present invention.

A temperature control valve 12 as shown in FIG. 4 is installed in the chamber 110 of the housing 11 to mix cold and hot waters together.

Two inlet pipes 13 are provided to supply the cold and the hot waters toward the temperature control valve 12 respectively.

A motor 14 is used to drive the temperature control valve 12.

At least one outlet pipe 15, wherein there are two outlet pipes 15 provided in this embodiment to output mixed cold and hot water in the temperature control valve 12.

At least one solenoid valve 16, wherein there are two solenoid valves 16 provided in this embodiment to turn on and off the outlet pipe 15.

The valve box 10 further includes a pressure balance valve 17 defined between the inlet pipe 15 and the temperature control valve 12, and two flow adjusting valves 18 defined between the pressure balance valve 17 and the inlet pipes 13, wherein a top end of the flow adjusting valve 18 corresponds to the apertures 114 of the cover 11*c* of the housing 11 and extends outward to be rotated, controlling a water flow easily by ways of a tool.

The controlling panel 20 is used to control and operate the valve box 10, and includes a body 21 and a removable adjusting knob 22, wherein the body 21 includes a first abutting portion 211 mounted around a peripheral side of a back surface thereof to contact with an external face 3*a* of a front fence 3 formed on a front side of the device 1 and to close the groove 3*b*, and a back side of the controlling panel 20 corresponds to the valve box 10 through the groove 3*b*, the adjusting knob 22 is installed at a central portion of the body 21 to be rotated, controlling the valve box 10.

The body 21 of the controlling panel 20 includes a positioning rim 212 integrally extending from a back side thereof, and the positioning rim 212 includes a non-circular second cliff 213 formed on an outer surface thereof. In this embodiment, the second cliff 213 is formed in an octagon shape, and when the first abutting portion 211 of the controlling panel 20 contacts with the external face 3*a* of the front fence 3, the groove 3*b* engages with the first cliff 115 of the side fringe 11*b* of the housing 11 to form an anti-rotating structure, thus preventing the controlling panel 20 from rotation, and the second cliff 213 slides in the first cliff 115.

The retaining means 30 includes two orifices 31, two bores 32, and two second bolts 33, wherein the orifice 31 is disposed on a central position of the cover 11*c* of the housing 11 and defined between two pillars 311; the bore 32 is mounted on a central portion of the body 21 of the controlling panel 20, in response to the orifice 31, and covered by the adjusting knob 22; the second bolt 33 is inserted through the bore 32 to screw with the orifice 31 so that the body 21 is fixed on the cover 11*c* of the valve box 10, and the first abutting portion 211 of the body 21 is biased against the external face 3*a* of the front fence 3.

Figure 12:
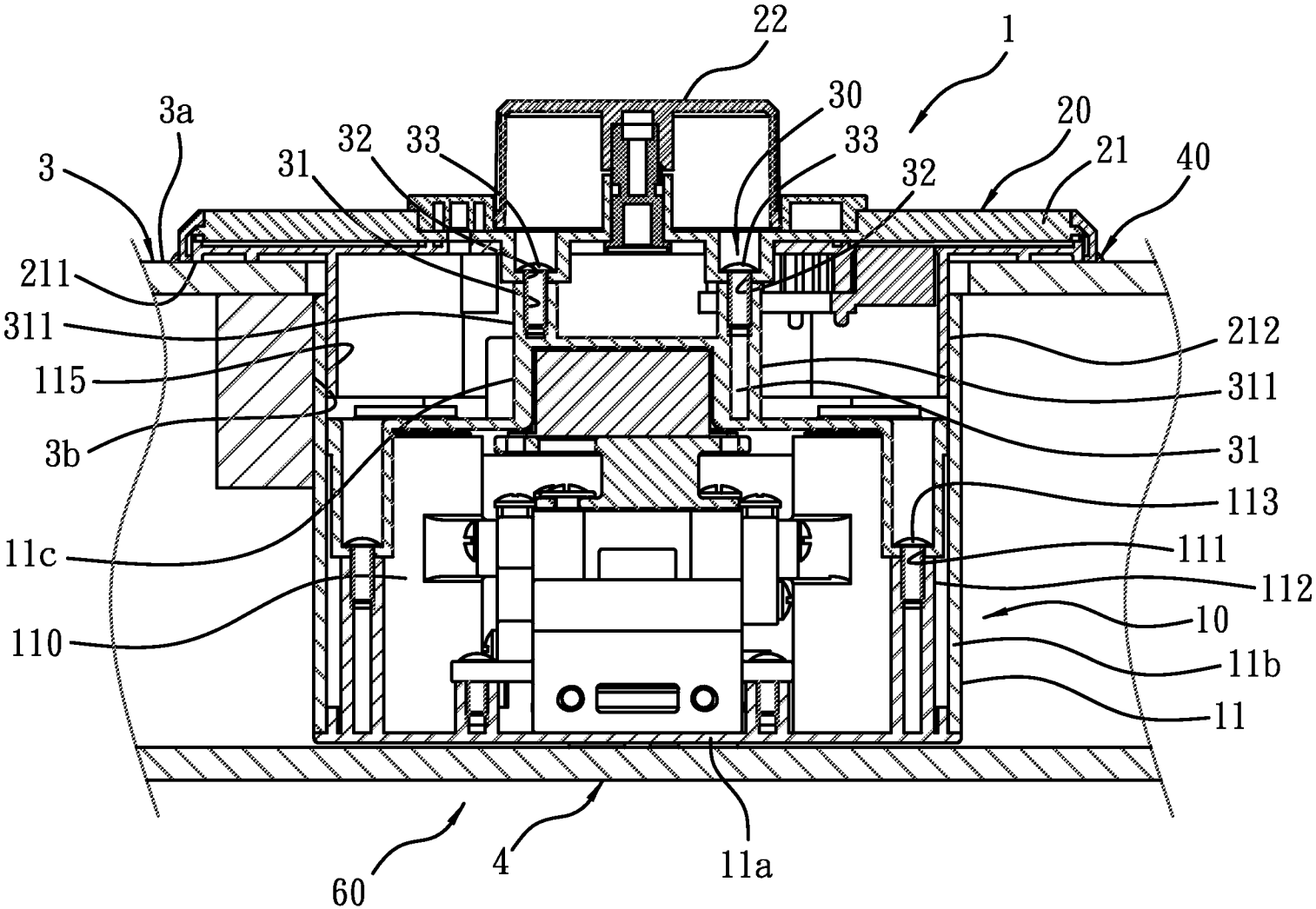
FIG. 12 is a cross sectional view showing the controlling panel being assembled and a wall being comprised of the frame, the front fence, and a rear fence according to the first embodiment of the present invention.

The closing means 40 includes a waterproof sealing structure defined between the first abutting portion 211 of the controlling panel 20 and the external face 3*a* of the front fence 3. As shown in FIG. 12, a waterproof sealing glue is applied between the first abutting portion 211 of the controlling panel 20 and the external face 3*a* of the front fence 3 to prevent showering water from permeating into the device 1.

A removable wire is electrically connected between the controlling panel 20 and the valve box 10 as illustrated in FIG. 3, and includes a power line 51 and a control line 52, the wire 50 is long enough to remove the controlling panel 20 from the groove 3*b* so that the valve box 10 is cleaned, checked, and repaired via the groove 3*b*.

The controlling panel 20 receives power from the valve box 10 via the power line 51 and controls the valve box 10 by using the control line 52. The controlling panel 20 also allows to receive power from cells or in a wireless manner.

Figure 5:
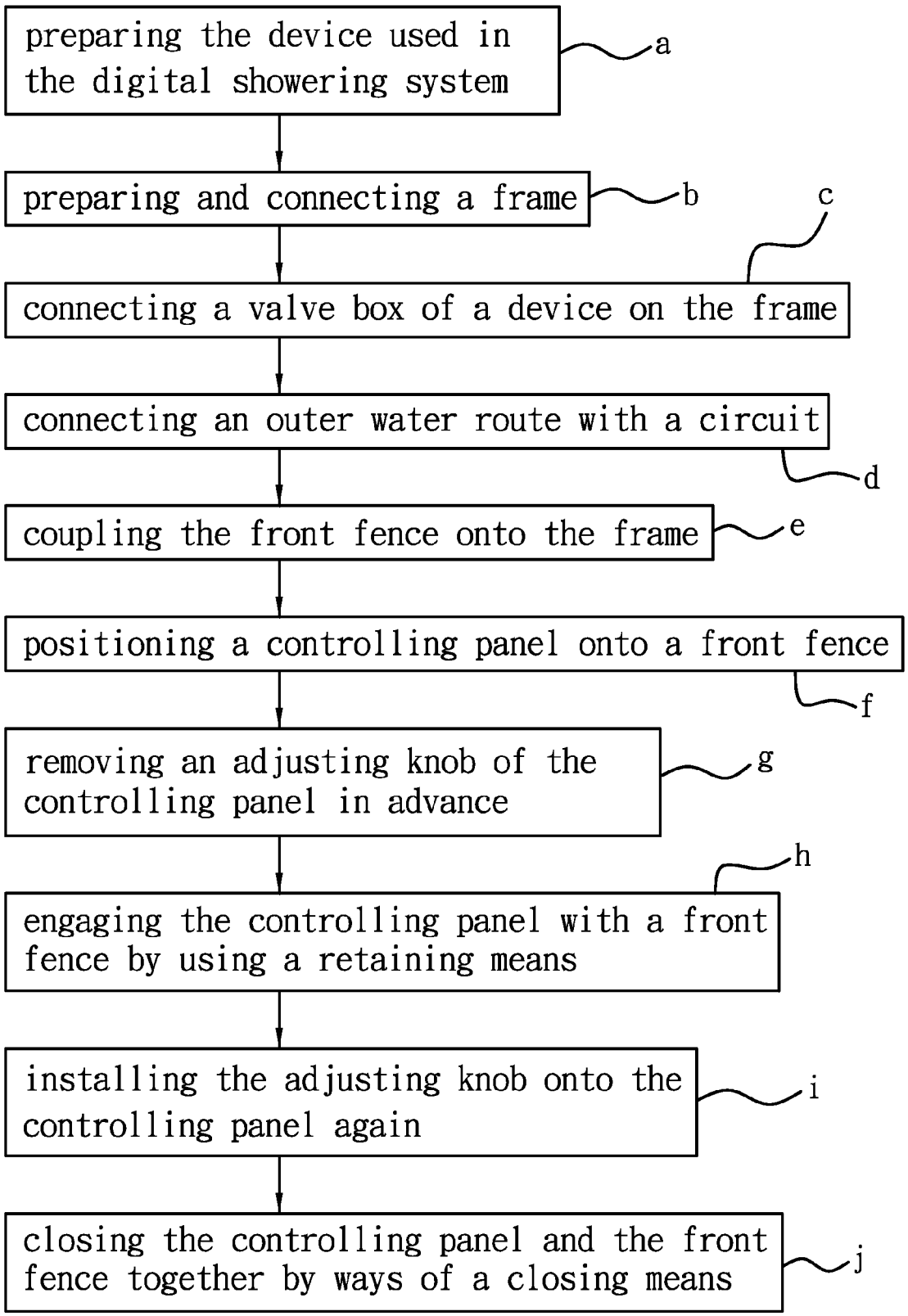
FIG. 5 is a flow chart showing an installing method of the device used in the digital shower system according to the first embodiment of the present invention.
Figure 8:
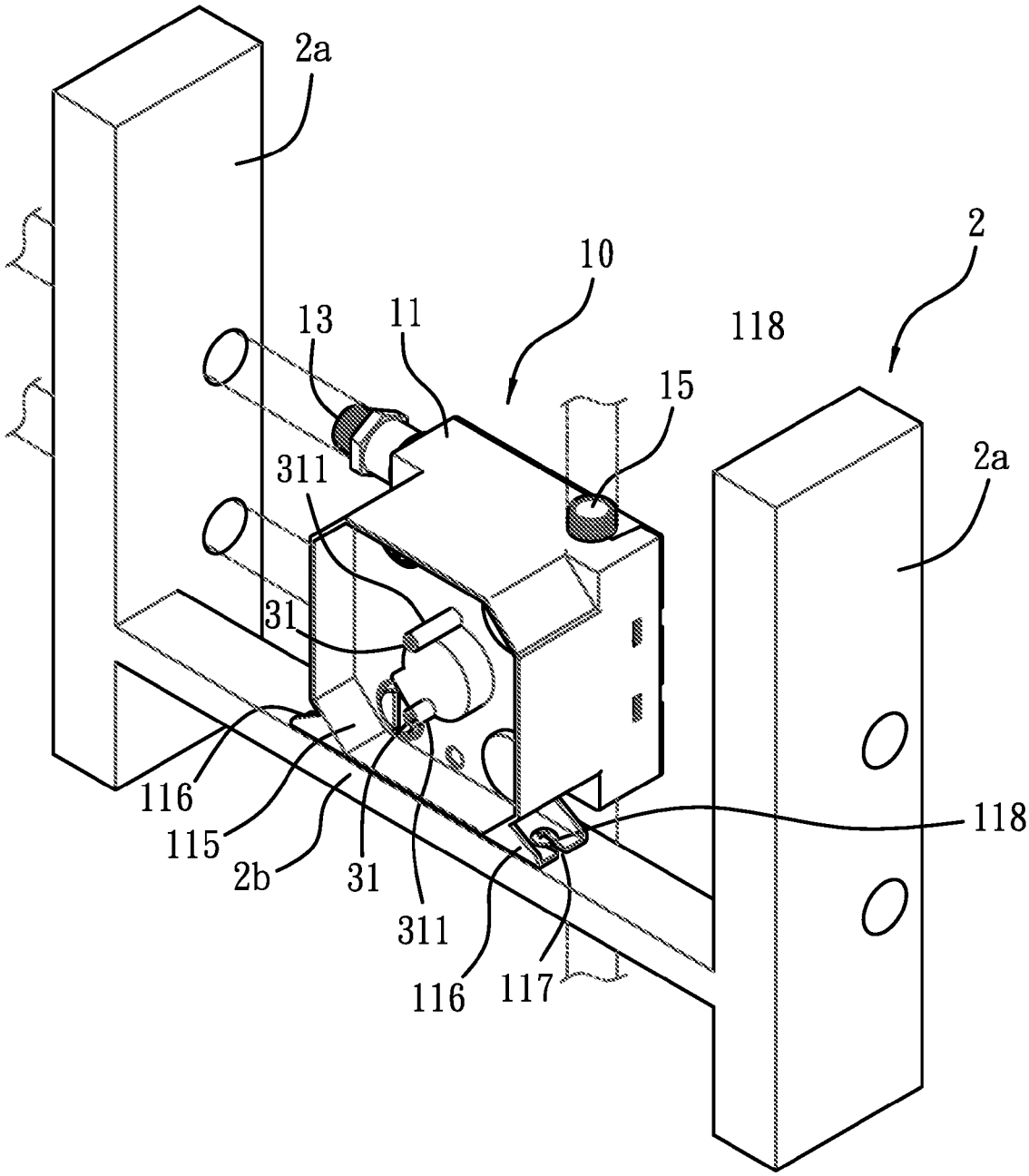
FIG. 8 is a perspective view showing the valve box being connected with an outer water route according to the first embodiment of the present invention.
Figure 9:
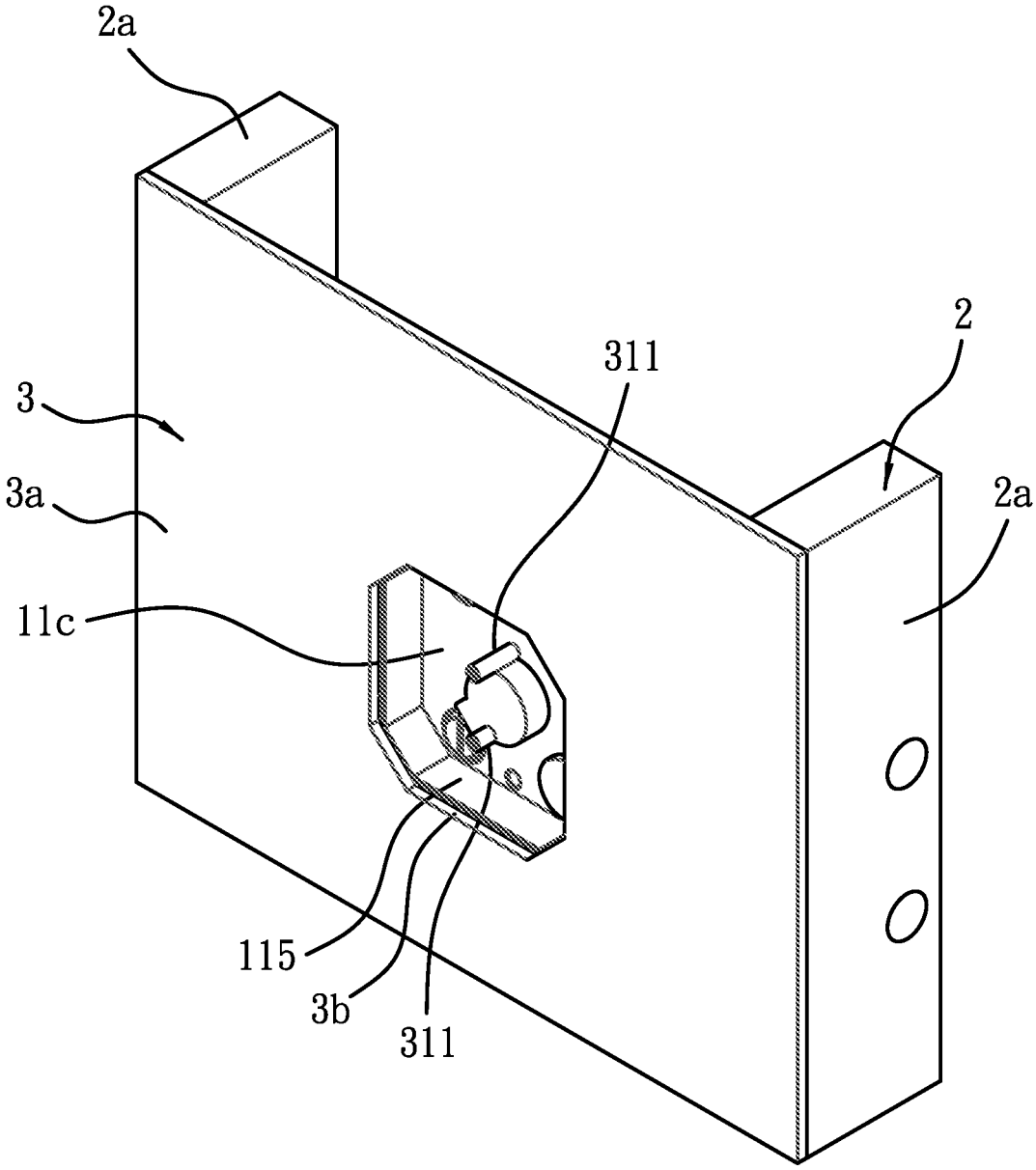
FIG. 9 is a perspective view showing a front fence being connected on a front side of the frame according to the first embodiment of the present invention.
Figure 10:
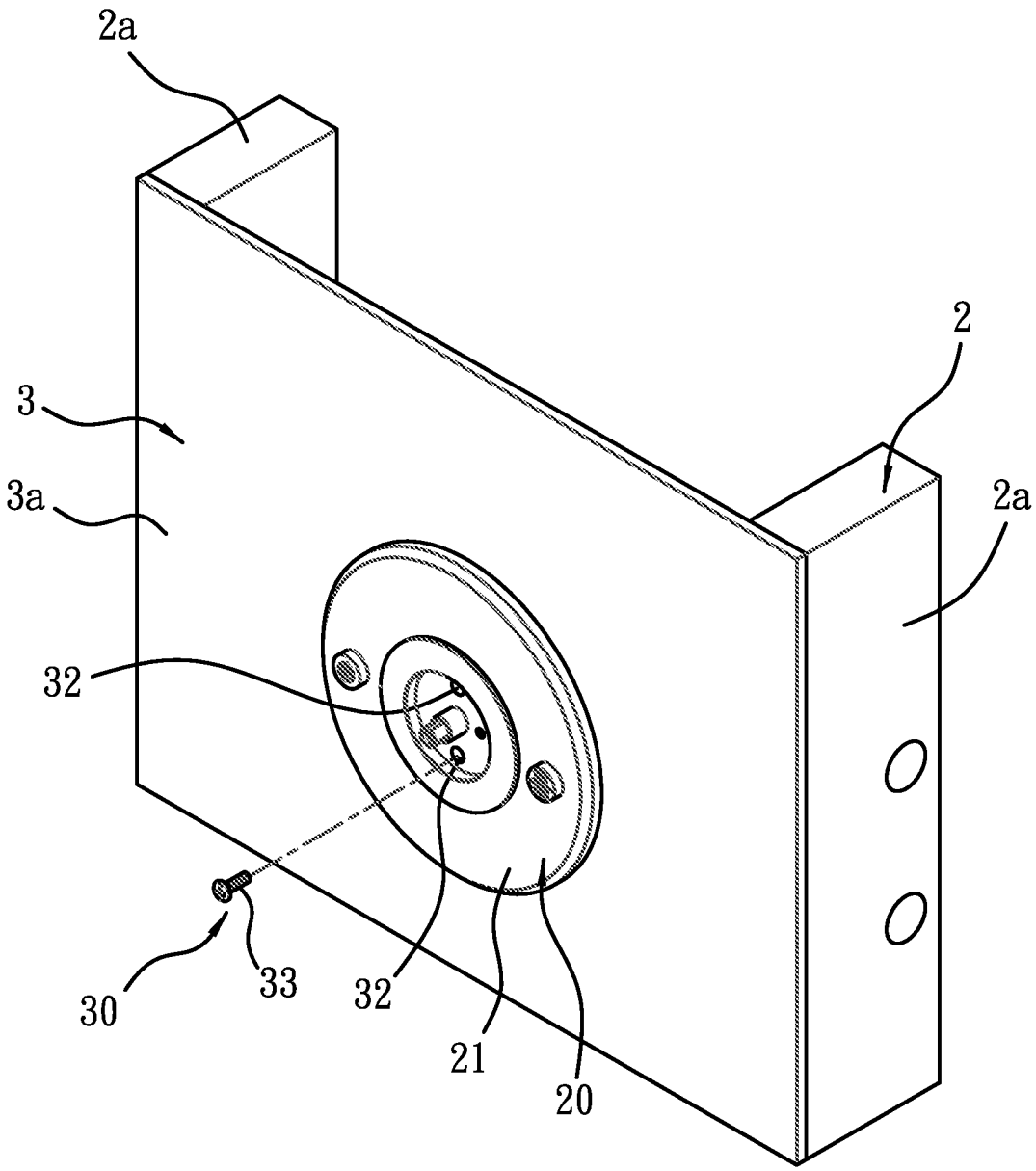
FIG. 10 is a perspective view showing a controlling panel being connected in a groove of the front fence and an adjusting knob being removed according to the first embodiment of the present invention.
Figure 11:
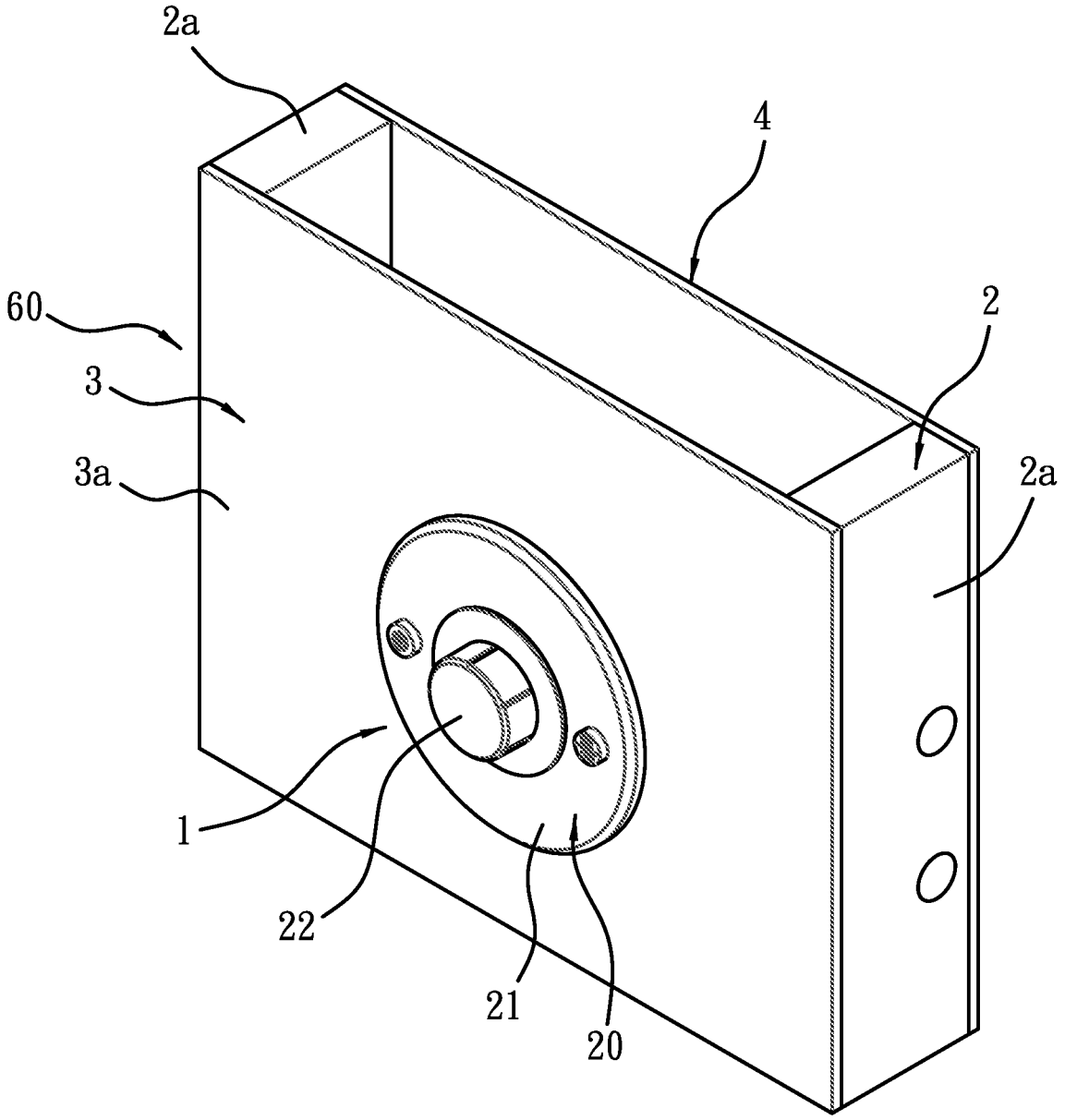
FIG. 11 is a perspective view showing the controlling panel being assembled and the adjusting knob being installed onto the controlling panel according to the first embodiment of the present invention.

As shown in FIG. 5, the device 1 used in the digital shower system according to the first embodiment of the present invention is installed in a showing room, and an installing method includes the steps of:

a. preparing the device 1 used in the digital shower system;

b. preparing and connecting the frame 2 as shown in FIG. 6; wherein the frame 2 is connected at a suitable position of the showering room and made of wood material, includes two vertical posts 2*a* disposed on two sides thereof respectively, and a horizontal rod 2*b* coupled at a middle portion of the vertical posts 2*a;* c. connecting the valve box 10 of the device 1 on the frame 2 as illustrated in FIG. 7; wherein the locking elements 118 are inserted through the openings 117 of the side fringe 11*b* of the valve box 10 to screw with the horizontal rod 2*b* so that the valve box 10 is coupled on the frame 2;

d. connecting an outer water route with a circuit as shown in FIG. 8;

wherein before installing the front fence 3, the inlet pipe 13 and the outlet pipe 15 of the valve box 10 are connected with the outer water route, and the valve box 10 is electrically coupled with an outer circuit;

e. coupling the front fence 3 onto the frame 2 as illustrated in FIG. 9; wherein the front fence 3 is covered onto the frame 2, and the groove 3*b* is in response to the valve box 10;

f. positioning the controlling panel 20 onto the front fence 3 as shown in FIG. 10; wherein the first abutting portion 211 of the controlling panel 20 is biased against the external face 3*a* of the front fence 3 so that the groove 3*b* of the front fence 3 is covered by the body 21, and the cover 11*c* of the housing 11 is in response to the back side of the controlling panel 20 through the groove 3*b* and removed from the groove 3*b;* g. removing the adjusting knob 22 of the controlling panel 20 in advance as shown in FIG. 10; wherein before executing the retaining means 30, the adjusting knob 22 of the controlling panel 20 is removed so that the bores 32 of the retaining means 30 exposes outside;

h. engaging the controlling panel 20 with the front fence 3 by using the retaining means 30 as shown in FIG. 10; wherein the second bolts 33 of the retaining means 30 are inserted through the bores 32 to screw with the orifices 31 of the cover 11*c* of the housing 11, and the first abutting portion 211 of the controlling panel 21 engages with the external face 3*a* of the front fence 3 so that the controlling panel 2 is connected with the valve box 10;

i. installing the adjusting knob 22 onto the controlling panel 20 again as illustrated in FIG. 11; wherein after the retaining means 30 is executed, the adjusting knob 22 is installed onto the controlling panel 20 to cover the bores 32 of the retaining means 30;

j. closing the controlling panel 20 and the front fence 3 together by ways of the closing means 40 as shown in FIG. 12 to finish an installation of the device 1; wherein the waterproof sealing glue is applied between the first abutting portion 211 of the controlling panel 20 and the external face 3*a* of the front fence 3 to generate the waterproof sealing structure so as to prevent the showering water from permeating into the controlling panel 20 and the valve box 10, thus protecting an inner circuit and electronic parts from damage and achieving a waterproof function.

It is to be noted that during positioning the controlling panel 20 at the front fence 3; the second cliff 213 of the controlling panel 20 is fitted into the first cliff 115 of the valve box 10 to form the anti-rotating structure to limit the controlling panel to be rotated.

After connecting the valve box 10 with the outer water route and the circuit together and before finishing the installing method of the first embodiment, a rear fence 4 is also coupled onto a back side of the frame 2 at a suitable time.

With reference to FIGS. 11 and 12, by using the above-mentioned installing method of the first embodiment, an installing structure is formed and includes the valve box 10, the controlling panel 20, the retaining means 30, the closing means 40, and a wall 60, wherein the wall 60 is comprised of the frame 2, the front fence 3, and the rear fence 4, and the front fence 3 includes the groove 3*b*, the first abutting portion 211 of the controlling panel 20 engages with the external face 3*a* of the front fence 3, and the back side of the controlling panel 20 is in response to the cover 11*c* of the valve box 10 via the groove 3*b*.

Figure 13:
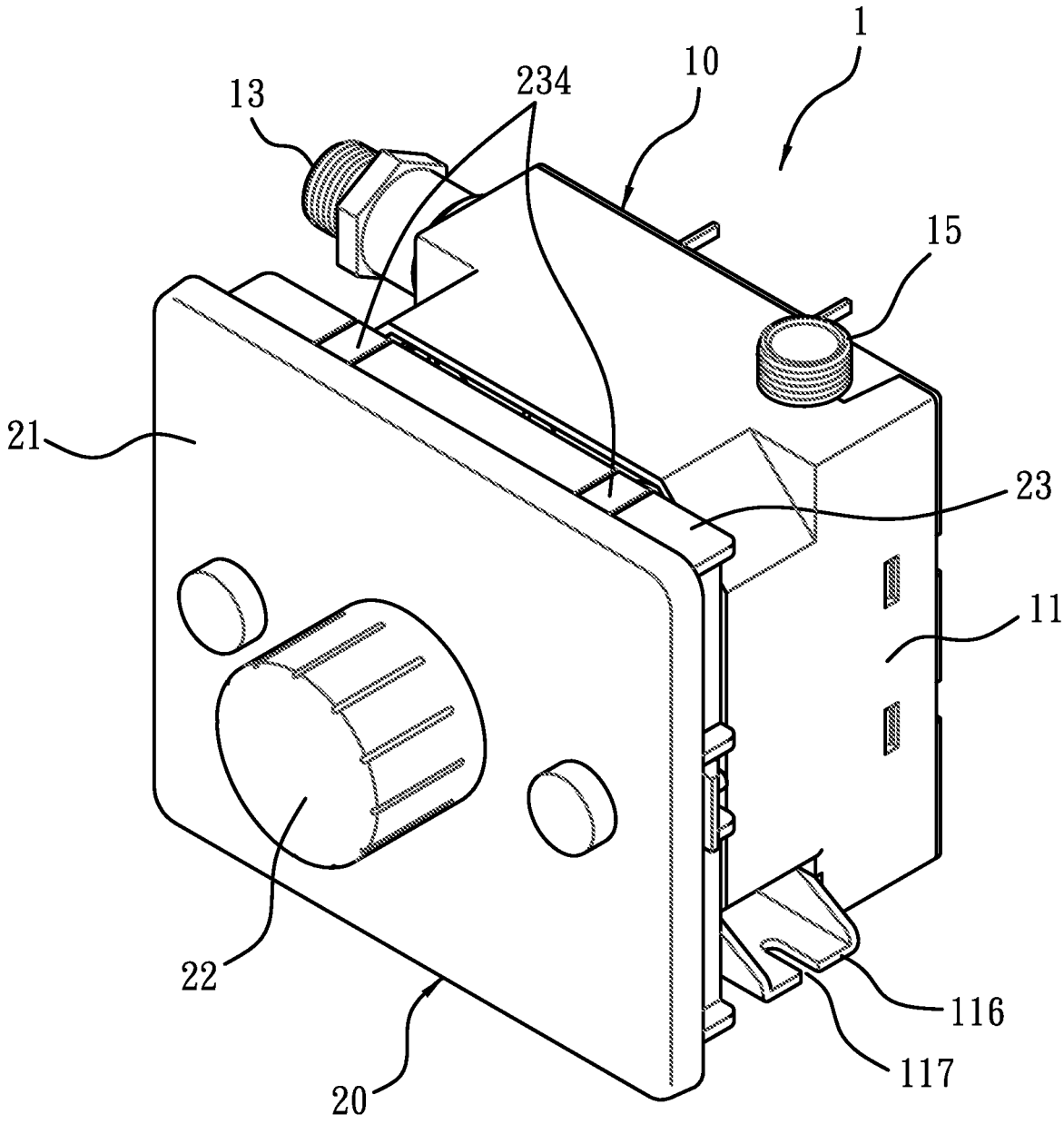
FIG. 13 is a perspective view showing the assembly of a device used in a digital shower system according to a second embodiment of the present invention.
Figure 14:
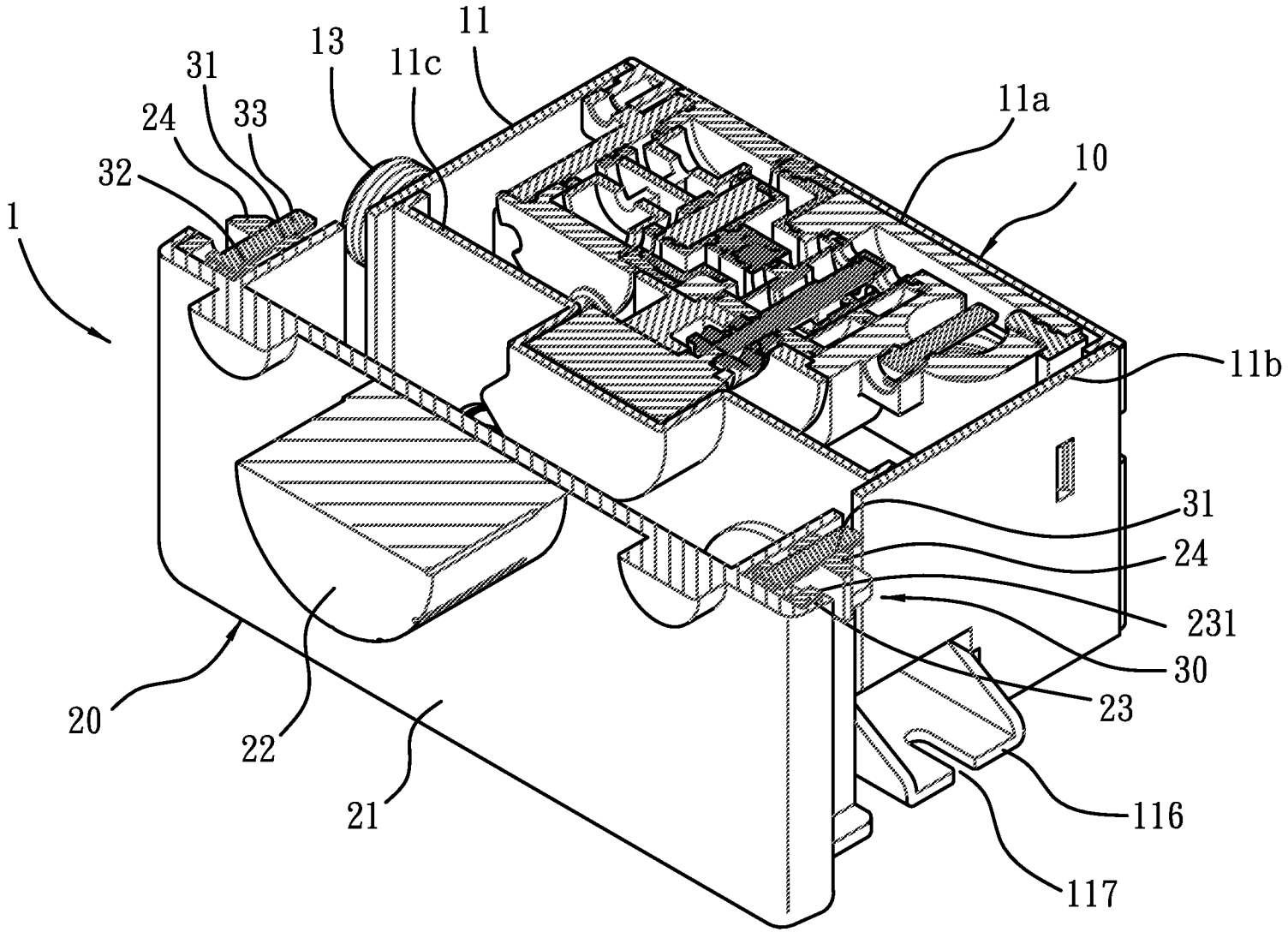
FIG. 14 is a perspective view showing the cross section of the assembly of the device used in the digital shower system according to the second embodiment of the present invention.
Figure 15:
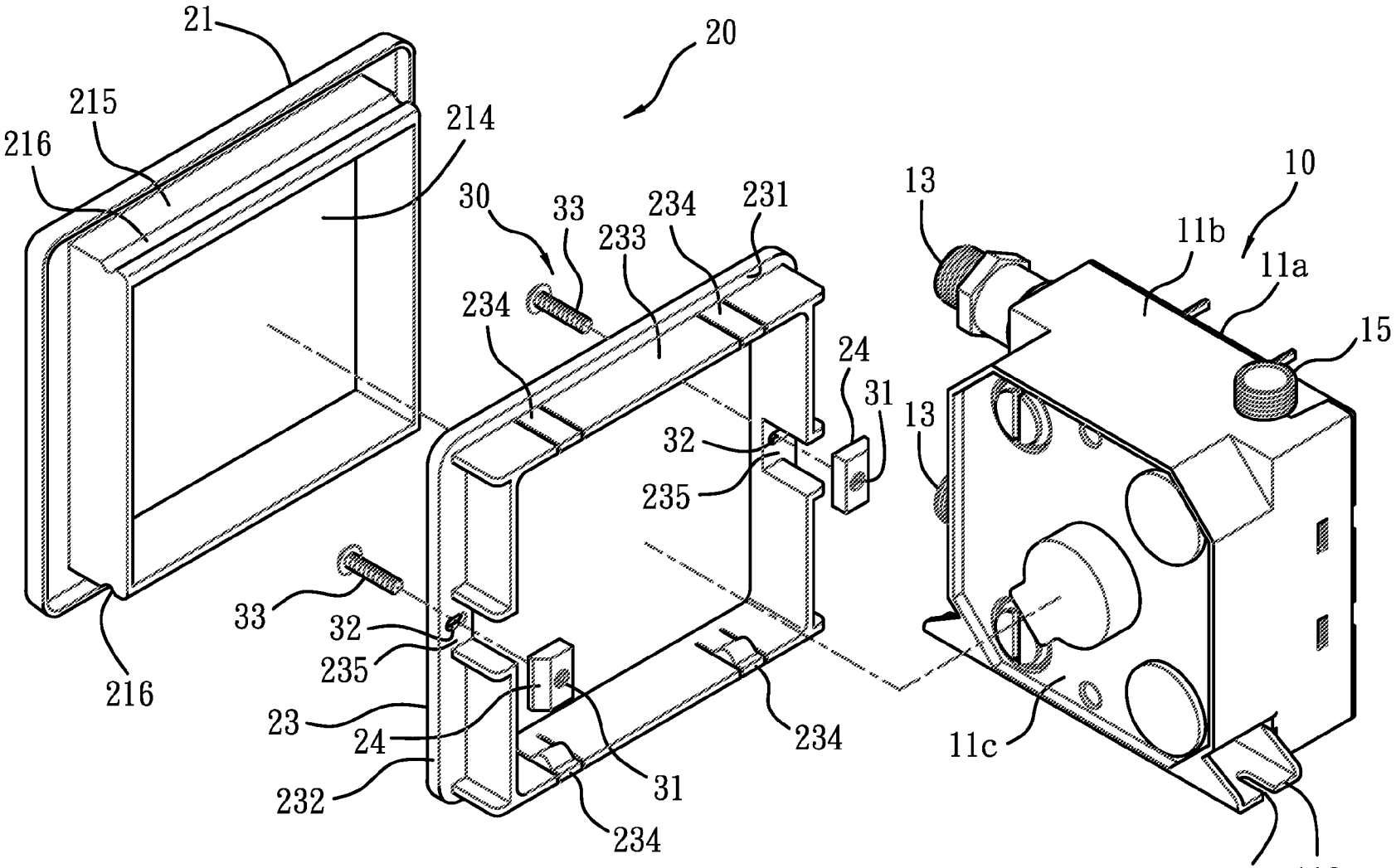
FIG. 15 is a perspective view showing the exploded components of the device used in the digital shower system according to the second embodiment of the present invention.
Figure 18:
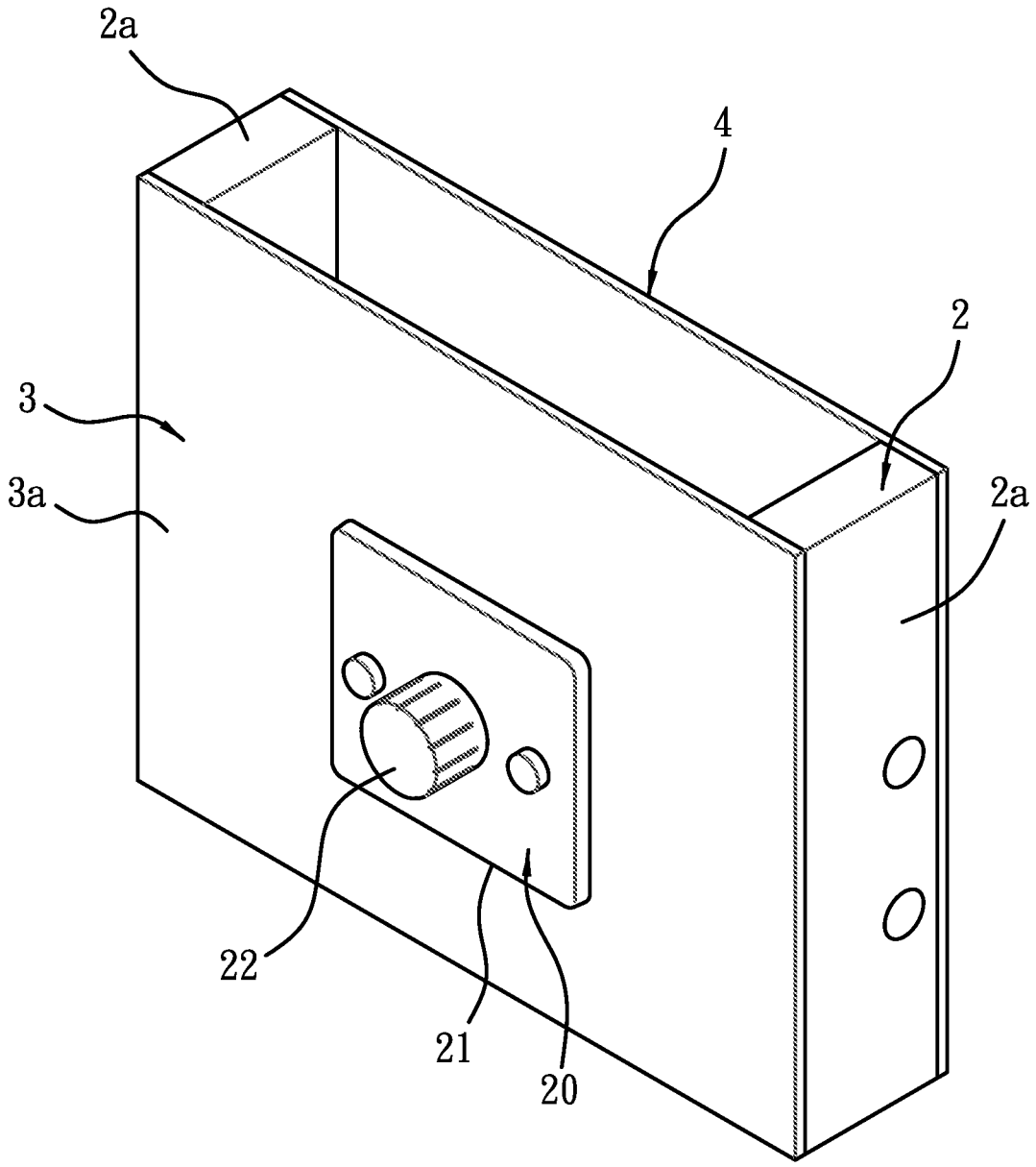
FIG. 18 is a perspective view showing a controlling panel being assembled according to the second embodiment of the present invention.
Figure 19:
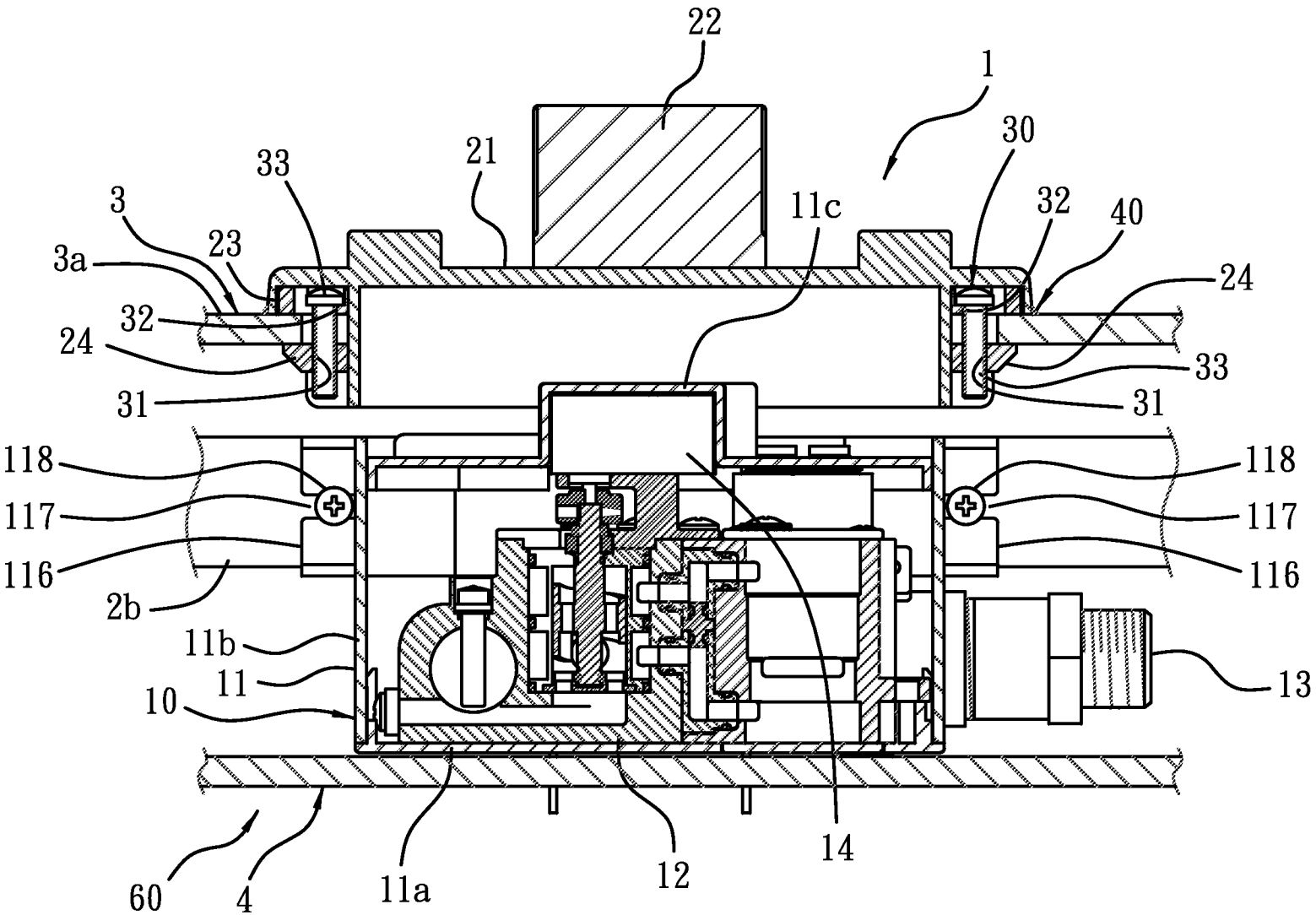
FIG. 19 is a cross sectional view showing the device used in the digital shower system being assembled, and a wall being comprised of the frame, the front fence, and a rear fence according to the second embodiment of the present invention.

Referring to FIGS. 13-15, a difference of a device 1 used in a digital shower system according to a second embodiment of the present invention from that of the first embodiment is:

a controlling panel 20 includes a fixing plate 23 and a body 21 to be retained in and removed from the fixing plate 23, the fixing plate 23 includes a second abutting portion 231 formed on a back side thereof to replace the first abutting portion 211 of the body 21 of the first embodiment;

a retaining means 30 includes two engaging blocks 34, each having an orifice 31, and the engaging blocks 34 are limited around a peripheral side of the fixing plate 23 and located at an inner side of a front fence 3, such that two second bolts 33 are inserted through two bores 32 to screw with the orifices 31 of the engaging blocks 34 so that the second abutting portion 231 of the fixing plate 23 engages with the external face 3*a* of the front fence 3 as illustrated in FIGS. 18 and 19;

the fixing plate 23 includes a pressing portion 232 and an outer peripheral segment 233 integrally extending from the pressing portion 232; the pressing portion 232 includes the second abutting portion 231 fixed around a back side thereof, and the outer peripheral segment 233 includes two symmetrical resilient locking members 234 and two defining slots 235 arranged therein to receive the engaging blocks 34; the body 21 includes a flat portion 214 and an inner peripheral segment 215 integrally extending from an inner surface of the flat portion 214; the inner peripheral segment 215 includes two symmetrical recesses 216 secured on an outer side thereof to engage with the resilient locking members 234, and when the flat portion 214 is connected to the fixing plate 23, it covers the pressing portion 232 of the fixing plate 23 and the bores 32 as illustrated in FIG. 14.

Figure 16:
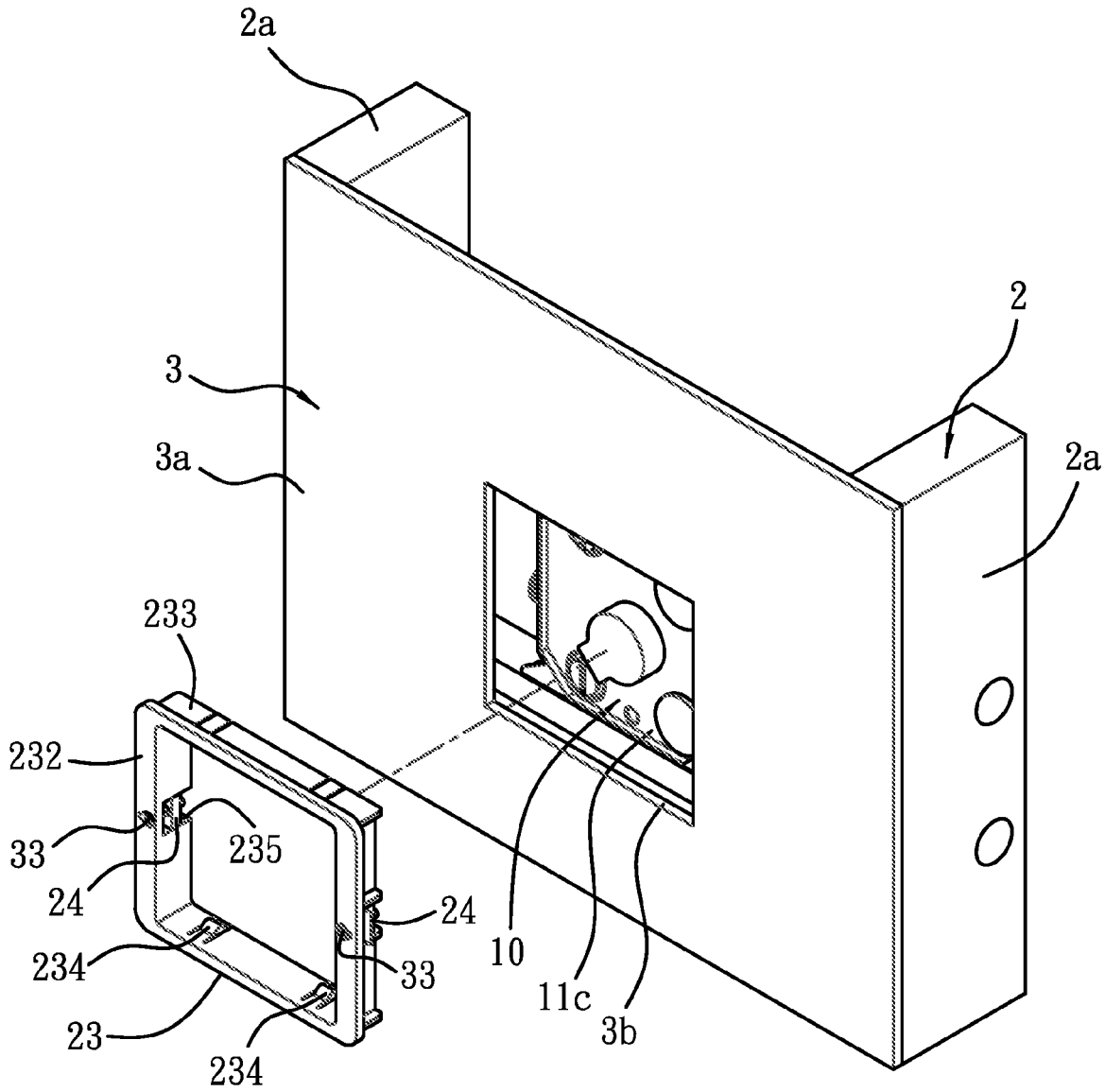
FIG. 16 is a perspective view showing a fixing plate of the device used in the digital shower system being connected on a front fence by using a retaining means according to the second embodiment of the present invention.
Figure 17:
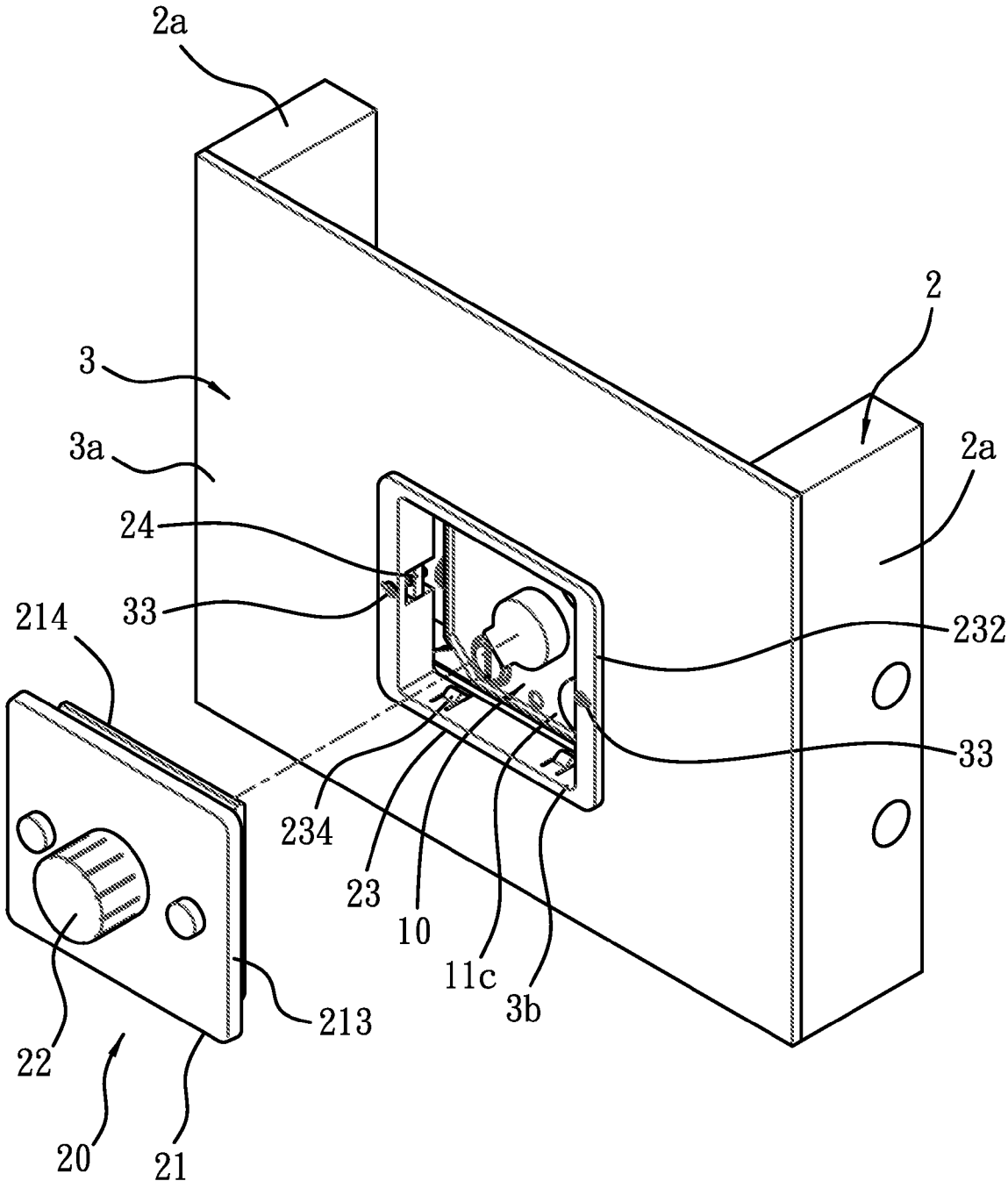
FIG. 17 is a perspective view showing a body of the device used in the digital shower system being connected on the fixing plate according to the second embodiment of the present invention.

The device 1 used in the digital shower system of the second embodiment is also installed in a showering room, and a difference of an installing method of the second embodiment from that of the first embodiment is:

the body 21 of the controlling panel 20 is removed in advance as shown in FIGS. 16 and 17 to expose the bores 32 of the fixing plate 30 outside;

the second bolts 33 are inserted through the bores 32 to screw with the orifices 31 as illustrated in FIGS. 16 and 19 so that the front fence 3 is fixed between the fixing plate 23 and the engaging blocks 34, and the second abutting portion 231 of the fixing plate 23 is biased against the external face 3*a* of the front fence 3;

after the retaining means 30 is executed, the fixing plate 23 is used to retain the recesses 216 of the inner peripheral segment 215 of the body 21 with the resilient locking members 234 of the outer peripheral segment 233 of the fixing plate 23 so that the body 21 is connected onto the fixing plate 23 again as illustrated in FIGS. 18 and 19 to cover the pressing portion 232 of the fixing plate 23 and the bores 32 of the retaining means 30.

In addition, the above-mentioned installing method is applied to form an installing structure, and a difference of the installing structure of the second embodiment from that of the first embodiment is:

the controlling panel 20 is fixed on the front fence 3 by matching the fixing plate 23 with the retaining means 30 as shown in FIG. 19;

the body 21 of the controlling panel 20 is removed from the fixing plate 23 to facilitate the embodiment of the retaining means as illustrated in FIGS. 16 and 17.

Thereby, when the valve box 10 is cleaned, checked and maintained, the adjusting knob 22 of the first embodiment or the body 21 of the second embodiment is removed so that the second bolts 33 of the retaining means 30 are exposed outside to be rotated releasably to remove the controlling panel 20 of the first embodiment or the body 21 of the second embodiment, such that the cleaning, checking, and maintaining process is executed through the groove 3*b* of the front fence 3 easily. Also, the cover 11*c* of the valve box 10 is removed from the groove 3*b* so that the inner circuit, the water route, and the related components of the valve box 10 are cleaned and check easily and quickly.

It is to be noted that when the controlling panel 20 of the first embodiment or the body 21 of the second embodiment is removed to clean and check the valve box 10, the waterproof sealing structure is removed together, accordingly the waterproof sealing glue is applied again to generate the waterproof sealing structure after finishing the cleaning and checking process.

The installing structures of the first and the second embodiments are used to make the controlling panel 20 and the valve box 10 locate at the same wall 60 to lower installing space and a distance between the circuit and the water route, thus decreasing installation cost and facilitating the cleaning and checking process.

A predetermined screwing travel between the second bolts 33 and the orifices 31 is adjusted automatically, for example, when the same device 1 is installed onto the front fences 3 with different thickness respectively, the screwing travel is adjusted automatically, wherein as the thickness of the front fence 3 of the wall 60 is within a common range, the retaining means 30 is used to adjust the screwing travel based on different thicknesses of the front fences 3 so that the first and the second abutting portions 211, 231 of the controlling panel 20 are engaged with the external face 3*a* of the front fence 3 after the retaining means 30 is embodied without being influenced by the thicknesses of the front fence 3. Therefore, the device 1 of the present invention is applicable to various front fences 3 with different thicknesses.

While we have shown and described various embodiments in accordance with the present invention, it is clear to those skilled in the art that further embodiments may be made without departing from the scope of the present invention.

What is claimed is:

1. A device used in a digital shower system comprising:

a valve box including a housing fixed on a frame;

a temperature control valve installed in the housing to mix cold and hot waters together;

two inlet pipes to supply the cold and the hot waters toward the temperature control valve respectively;

a motor to drive the temperature control valve;

at least one outlet pipe to output mixed cold and hot water in the temperature control valve;

at least one solenoid valve to turn on and off the outlet pipe;

a controlling panel to control and operate the valve box, and including a first abutting portion mounted around a peripheral side of a back surface thereof to contact with an external face of a front fence formed on a front side of the device and to close a groove of the front fence, and a back side of the controlling panel corresponding to the valve box through the groove;

a retaining means including at least one bolt and at least one orifice for corresponding to the at least one bolt, the at least one bolt being inserted through a predetermined portion of the controlling panel to screw with the at least one orifice by using a determined screwing travel so that the first abutting portion of the controlling panel is biased against the external face of the front fence;

wherein the controlling panel includes a fixing plate and a body retained in and removed from the fixing plate, the fixing plate includes a second abutting portion formed on a back side thereof;

the retaining means includes two bolts, two bores mounted around the fixing plate, and two engaging blocks limited around a peripheral side of the fixing plate and located at an inner side of the front fence, and each engaging block has an orifice for corresponding to each bore, such that the two bolts are inserted through the two bores to screw with the two orifices of the two engaging blocks so that the second abutting portion of the fixing plate engages with the external face of the front fence.

2. The device used in a digital shower system as claimed in claim 1 further comprising a closing means to apply waterproof sealing glue between the first abutting portion of the controlling panel and the external face of the front fence to form a waterproof sealing structure.

3. The device used in a digital shower system as claimed in claim 1, wherein the housing further including a removable cover, and the cover is in response to the back side of the controlling panel via the groove.

4. The device used in a digital shower system as claimed in claim 1, wherein the retaining means includes two bolts, two bores mounted on the controlling panel, and two orifices disposed on a cover of the housing so as to correspond to the two bores, and the first abutting portion of the controlling panel is biased against the external face of the front fence by inserting the two bolts through the two bores to screw with the two orifices.

5. The device used in a digital shower system as claimed in claim 4, wherein the controlling panel further includes a removable adjusting knob to cover the bores.

6. The device used in a digital shower system as claimed in claim 1, wherein the controlling panel is fitted into the valve box to form an anti-rotating structure to limit the controlling panel to be rotated.

7. The device used in a digital shower system as claimed in claim 6, wherein the anti-rotating structure includes a non-circular first cliff arranged on a side fringe connected with a peripheral side of the housing, and a non-circular second cliff formed on an outer surface of a positioning rim of the controlling panel, and when the first abutting portion of the controlling panel contacts with the external face of the front fence, the groove engages with the first cliff of the side fringe of the housing to form the anti-rotating structure, thus preventing the controlling panel from rotation, and the second cliff slides in the first cliff.

8. The device used in a digital shower system as claimed in claim 1, wherein the fixing plate includes a pressing portion and an outer peripheral segment integrally extending from the pressing portion; the pressing portion includes the second abutting portion fixed around a back side thereof, and the outer peripheral segment includes two symmetrical resilient locking members and two defining slots arranged therein to receive the engaging blocks; the body includes a flat portion and an inner peripheral segment integrally extending from an inner surface of the flat portion; the inner peripheral segment includes two symmetrical recesses secured on an outer side thereof to engage with the resilient locking members, and when the flat portion is connected to the fixing plate, it covers the pressing portion of the fixing plate and the bores.

9. The device used in a digital shower system as claimed in claim 1, wherein a removable wire is electrically connected between the controlling panel and the valve box, and includes a power line and a control line, the wire is long enough to remove the controlling panel from the groove so that the valve box is cleaned, checked, and repaired via the groove.

10. The device used in a digital shower system as claimed in claim 1, wherein the controlling panel allows to control the valve box in a wireless manner.

11. An installing structure of a device used in a digital shower system comprising a wall, and the wall including a frame and a front fence fixed on the frame, the front fence includes a groove formed in a predetermined size and shape;

a valve box including:

a housing fixed on the frame and corresponding to the groove of the front fence;

a temperature control valve installed in the housing to mix cold and hot waters together;

two inlet pipes to supply the cold and the hot waters toward the temperature control valve respectively;

a motor to drive the temperature control valve;

at least one outlet pipe to output mixed cold and hot water in the temperature control valve;

at least one solenoid valve to turn on and off the outlet pipe;

a controlling panel including a first abutting portion mounted around a peripheral side of a back surface thereof to contact with an external face of the front fence and to close the groove of the front fence, and a back side of the controlling panel corresponding to the valve box through the groove;

a retaining means including at least one bolt, and at least one orifice corresponding to the at least one bolt, the at least one bolt being inserted through a predetermined portion of the controlling panel to screw with the at least one orifice by using a determined screwing travel so that the first abutting portion of the controlling panel is biased against the external face of the front fence;

wherein the controlling panel includes a fixing plate and a body retained in and removed from the fixing plate, the fixing plate includes a second abutting portion formed on a back side thereof;

the retaining means includes two bolts, two bores mounted around the fixing plate, and two engaging blocks limited around a peripheral side of the fixing plate and located at an inner side of the front fence; each engaging block has an orifice for corresponding to each bore, such that the two bolts are inserted through the two bores to screw with the two orifices of the two engaging blocks so that the second abutting portion of the fixing plate engages with the external face of the front fence.

12. An installing structure of the device used in the digital shower system as claimed in claim 11 further comprising a closing means, wherein waterproof sealing glue is applied between the first abutting portion of the controlling panel and the external face of the front fence to generate a) waterproof sealing structure.

13. An installing structure of the device used in the digital shower system as claimed in claim 11, wherein the housing includes a removable cover, and the cover corresponds to the back side of the controlling panel via the groove.

14. An installing structure of the device used in the digital shower system as claimed in claim 11, wherein the retaining means includes two bolts, two bores mounted on the controlling panel, and two orifices disposed on a cover of the housing so as to correspond to the two bores, and the first abutting portion of the controlling panel is biased against the external face of the front fence by inserting the two bolts through the two bores to screw with the two orifices.

15. An installing structure of the device used in the digital shower system as claimed in claim 14, wherein the controlling panel further includes a removable adjusting knob to cover the two bores.

16. An installing structure of the device used in the digital shower system as claimed in claim 11, wherein the controlling panel is fitted into the valve box to form an anti-rotating structure.

17. An installing structure of the device used in the digital shower system as claimed in claim 16, wherein the anti-rotating structure includes a non-circular first cliff arranged on a side fringe connected with a peripheral side of housing, and a non-circular second cliff formed on an outer surface of a positioning rim of the controlling panel, and when the first abutting portion of the controlling panel contacts with the external face of the front fence, the groove engages with the first cliff of the side fringe of the housing to form the anti-rotating structure, thus preventing the controlling panel from rotation, and the second cliff slides in the first cliff.

18. An installing structure of the device used in the digital shower system as claimed in claim 11, wherein the fixing plate includes a pressing portion and an outer peripheral segment integrally extending from the pressing portion; the pressing portion includes the second abutting portion fixed around a back side thereof, and the outer peripheral segment includes two symmetrical resilient locking members and two defining slots arranged therein to receive the engaging blocks; the body includes a flat portion and an inner peripheral segment integrally extending from an inner surface of the flat portion; the inner peripheral segment includes two symmetrical recesses secured on an outer side thereof to engage with the resilient locking members, and when the flat portion is connected to the fixing plate, it covers the pressing portion of the fixing plate and the bores.

19. An installing structure of the device used in the digital shower system as claimed in claim 11, wherein a removable wire is electrically connected between the controlling panel and the valve box, and includes a power line and a control line, the wire is long enough to remove the controlling panel from the groove so that the valve box is cleaned, checked, and repaired via the groove.

20. An installing structure of the device used in the digital shower system as claimed in claim 11, wherein the controlling panel allows to control the valve box in a wireless manner.

* * * * *